US009273679B2

(12) United States Patent
Suzuki et al.

(10) Patent No.: US 9,273,679 B2
(45) Date of Patent: Mar. 1, 2016

(54) VARIABLE DISPLACEMENT SWASH PLATE COMPRESSOR

(71) Applicant: KABUSHIKI KAISHA TOYOTA JIDOSHOKKI, Kariya-shi, Aichi-ken (JP)

(72) Inventors: Takahiro Suzuki, Kariya (JP); Masaki Ota, Kariya (JP); Shinya Yamamoto, Kariya (JP); Kazunari Honda, Kariya (JP); Kei Nishii, Kariya (JP); Yusuke Yamazaki, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 132 days.

(21) Appl. No.: 14/224,311

(22) Filed: Mar. 25, 2014

(65) Prior Publication Data

US 2014/0294611 A1 Oct. 2, 2014

(30) Foreign Application Priority Data

Mar. 27, 2013 (JP) ..... 2013-067088

(51) Int. Cl.
*F04B 27/10* (2006.01)
*F04B 27/12* (2006.01)
(Continued)

(52) U.S. Cl.
CPC ..... *F04B 27/086* (2013.01); *F04B 27/1072* (2013.01); *F04B 27/18* (2013.01); *F04B 2027/1813* (2013.01)

(58) Field of Classification Search
CPC ..... F04B 27/10; F04B 27/12; F04B 27/14; F04B 27/16; F04B 27/18; F04B 27/1054; F04B 27/1804; F04B 2027/1813; F04B 2027/1822; F04B 2027/1831
USPC ..... 417/222.1, 222.2, 269, 270
See application file for complete search history.

(56) References Cited

U.S. PATENT DOCUMENTS 4,037,993 A 7/1977 Roberts
4,061,443 A * 12/1977 Black ..... F04B 27/1072 184/6.17

(Continued)

FOREIGN PATENT DOCUMENTS

JP 58-162780 A 9/1983
JP 64-41680 A 2/1989

(Continued)

OTHER PUBLICATIONS

Communication dated Aug. 4, 2014, from the European Patent Office in counterpart European Patent Application No. 14161025.3.

*Primary Examiner* — Peter J Bertheaud
(74) *Attorney, Agent, or Firm* — Sughrue Mion, PLLC

(57) ABSTRACT

A variable displacement swash plate compressor includes a housing, drive shaft, first and second radial bearings, swash plate, and actuator. The actuator includes a movable body and fixed body. The movable body includes a main portion and circumferential wall. The main portion includes an insertion hole. The housing includes an accommodation wall. A first clearance exists between the circumferential wall and fixed body. A second clearance exists between the drive shaft and wall of the insertion hole. A third clearance exists between the circumferential wall and accommodation wall. A fourth clearance exists between the drive shaft and first radial bearing. A fifth clearance exists between the drive shaft and second radial bearing. The first and second clearances differ in size. The sum of the third clearance and the smaller one of the first and second clearances is larger than the fourth and fifth clearances.

5 Claims, 7 Drawing Sheets

(51) Int. Cl.

| | |
|---|---|
| ***F04B 27/16*** | (2006.01) |
| ***F04B 27/18*** | (2006.01) |
| ***F04B 27/08*** | (2006.01) |

(56) References Cited

U.S. PATENT DOCUMENTS

| | | | | | |
|---|---|---|---|---|---|
| 4,174,191 | A | * | 11/1979 | Roberts | F04B 27/18 417/222.1 |
| 4,297,085 | A | * | 10/1981 | Brucken | F04B 27/1054 417/222.1 |
| 4,963,074 | A | * | 10/1990 | Sanuki | F04B 27/18 417/222.1 |
| 5,022,826 | A | * | 6/1991 | Matsuda | F04B 27/12 417/222.1 |
| 5,032,060 | A | * | 7/1991 | Kobayashi | F04B 27/12 417/222.1 |
| 5,259,736 | A | * | 11/1993 | Terauchi | F01B 3/106 417/222.1 |
| 5,370,503 | A | * | 12/1994 | Terauchi | F04B 27/1072 417/222.2 |
| 5,547,346 | A | * | 8/1996 | Kanzaki | F04B 49/022 417/222.2 |
| 5,772,407 | A | * | 6/1998 | Kato | F04B 27/109 184/6.16 |
| 5,921,756 | A | * | 7/1999 | Matsuda | F04B 27/12 417/269 |
| 6,142,745 | A | * | 11/2000 | Kawaguchi | F04B 27/1804 417/222.2 |
| 6,742,439 | B2 | | 6/2004 | Matsuda et al. | |
| 2012/0073430 | A1 | | 3/2012 | Uchikado | |

FOREIGN PATENT DOCUMENTS

| | | | |
|---|---|---|---|
| JP | 1-147171 | A | 6/1989 |
| JP | 2-16374 | A | 1/1990 |
| JP | 2-19665 | A | 1/1990 |
| JP | 3-10082 | U | 1/1991 |
| JP | 4-54287 | A | 2/1992 |
| JP | 5-18355 | A | 1/1993 |
| JP | 5-172052 | A | 7/1993 |
| JP | 2007-239722 | A | 9/2007 |

* cited by examiner

VARIABLE DISPLACEMENT SWASH PLATE COMPRESSOR

BACKGROUND OF THE INVENTION

The present invention relates to a variable displacement swash plate compressor.

Japanese Laid-Open Patent Publication No. 5-172052 discloses a variable displacement swash plate compressor (hereinafter referred to as compressor). The compressor includes a housing formed by a front housing segment, a cylinder block, and a rear housing segment. The front housing segment includes a first suction chamber and a first discharge chamber. The rear housing segment includes a second suction chamber and a second discharge chamber. The rear housing includes a pressure adjustment chamber.

The cylinder block includes a swash plate chamber and cylinder bores. Each cylinder bore includes a first cylinder bore, which is formed in the front side of the cylinder block, and a second cylinder bore, which is formed in the rear side of the cylinder block. A radial bearing is arranged near the first cylinder bores of the cylinder block. A control pressure chamber, which is connected to the pressure adjustment chamber, is formed near the second cylinder bores of the cylinder block.

A drive shaft, which extends through the housing, is rotatably supported by radial bearings in the cylinder block. A swash plate, which is rotated by the drive shaft, is arranged in the swash plate chamber. A link mechanism is located between the drive shaft and the swash plate to change the inclination angle of the swash plate. The inclination angle refers to the angle of the swash plate relative to a direction that is orthogonal to the rotation axis of the drive shaft. Each cylinder bore receives a piston, which is reciprocated in the cylinder bore to form a compression chamber. When the swash plate rotates, a conversion mechanism reciprocates the piston in each cylinder bore with a stroke that is in accordance with the inclination angle. An actuator changes the inclination angle of the actuator, and a control mechanism controls the actuator.

The actuator, which is arranged in the control pressure chamber, is not allowed to rotate integrally with the drive shaft. More specifically, the actuator includes a non-rotation movable body that covers a rear end of the drive shaft. An inner surface of the non-rotation movable body supports the rear end of the drive shaft so that the drive shaft is rotatable relative to the non-rotation movable body and movable in the axial direction. An outer surface of the non-rotation movable body is movable in the axial direction in the control pressure chamber but not about the rotation axis. A pushing spring is arranged in the control pressure chamber to urge the non-rotation movable body toward the front. The actuator includes a movable body that is coupled to the swash plate and movable in the axial direction. A thrust bearing is arranged between the non-rotation movable body and the movable body. A pressure control valve is arranged between the pressure adjustment chamber and the discharge chamber to change the pressure in the control pressure chamber and move the non-rotation movable body and the movable body in the axial direction.

The link mechanism includes a movable body and a lug arm, which is fixed to the drive shaft. The rear end of the lug arm includes an elongated hole that extends toward the rotation axis from the outer side in a direction orthogonal to the rotation axis. A pin is inserted into the elongated hole to support the front side of the swash plate so that the front side is tiltable about a first tilt axis. The front end of the movable body includes an elongated hole that extends toward the rotation axis from the outer side in a direction orthogonal to the rotation axis. A pin is inserted into the elongated hole to support the rear side of the swash plate so that the rear side is tiltable about a second tilt axis, which is parallel to the first tilt axis.

In the compressor, the pressure adjustment valve is controlled to open and connect the discharge chamber and the pressure adjustment chamber so that the pressure of the control pressure chamber becomes higher than the pressure of the swash plate chamber. This moves the non-rotation movable body and the movable body forward. As a result, the inclination angle of the swash plate increases, and the stroke of the pistons increases. The compressor displacement of the compressor for each drive shaft rotation also increases. When the pressure adjustment valve is controlled to close and disconnect the discharge chamber and the pressure adjustment chamber, the pressure of the control pressure chamber decreases to the same level as the pressure in the swash plate chamber. This moves the non-rotation movable body and the movable body rearward. As a result, the inclination angle of the swash plate decreases, and the stroke of the pistons decreases. The compressor displacement of the compressor for each drive shaft rotation also decreases.

In a compressor like the one described above, compression reaction force, discharge reaction force, and the like that act on the pistons produce a radial load that acts on the drive shaft. Thus, even though the radial bearings are arranged between the housing and the drive shaft, displacement of the drive shaft in the radial direction is unavoidable. This tendency is especially outstanding in the compressor described above because there is no radial bearing in the proximity of the first cylinder bores. In such a compressor, when the actuator moves, the non-rotation movable body moves in the axial direction relative to the drive shaft inside the control pressure chamber.

In the above compressor, an O-ring is arranged between the outer surface of the non-rotation movable body and the inner surface of the control pressure chamber. When the actuator moves in the compressor, the radial load produced by the drive shaft may deform the O-load beyond a tolerable margin. In this case, the outer surface of the non-rotation movable body may interfere with the inner surface of the control pressure chamber, and a friction force proportional to the radial load would act between the outer surface of the non-rotation movable body and the inner surface of the control pressure chamber. This would hinder forward and rearward movement of the non-rotation movable body and the movable body in the compressor. Thus, the controllability would be low when varying the compressor displacement.

In particular, when increasing the inclination angle of the swash plate to increase the compressor displacement, the radial load acting on the drive shaft increases. This increases the friction force. Thus, the time used to increase the compressor displacement would become longer. This would affect the response of the compressor and cause a cooling delay. In order to avoid such a situation, the control pressure chamber would have to be enlarged in the radial direction so that the non-rotation movable body and the movable body overcome the friction force when moving forward. However, this would enlarge the housing and consequently the compressor. Thus, limitations may be imposed on the arrangement of the compressor when installing the compressor in a vehicle or the like.

When enlarging the control pressure chamber in the radial direction to increase the compressor displacement, the volume of the control pressure chamber increases, and a longer time would be used to decrease the pressure of the control pressure chamber. In this case, the compressor displacement cannot be readily decreased when the vehicle is accelerated. Further, if there is a delay in the decrease of the compression when the engine speed is low and the compressor displacement remains high, the control executed by an ECU may stall the engine. If the engine were to be controlled in accordance with such slow changes in the compressor displacement, the control executed by the ECU would be complicated.

SUMMARY OF THE INVENTION

It is an object of the present invention to provide a variable displacement swash plate compressor that readily increases and decreases the compressor displacement while improving the controllability and allowing for reduction in size.

One aspect of the present invention is a variable displacement swash plate compressor. The compressor includes a housing, a drive shaft, a swash plate, a link mechanism, a piston, a conversion mechanism, an actuator, and a control mechanism. The housing includes a suction chamber, a discharge chamber, a swash plate chamber, and a cylinder bore. The drive shaft is supported to be rotatable in the housing. The swash plate is rotatable in the swash plate chamber when the drive shaft rotates. The link mechanism is arranged between the drive shaft and the swash plate. The link mechanism allows an inclination angle of the swash plate to be changed relative to a direction orthogonal to a rotation axis of the drive shaft. The piston is reciprocated in the cylinder bore. The conversion mechanism reciprocates the piston in the cylinder bore with a stroke corresponding to the inclination angle when the swash plate rotates. The actuator is capable of changing the inclination angle. The control mechanism controls the actuator. The cylinder bore includes a first cylinder bore, located at one side of the swash plate, and a second cylinder bore, located at an opposite side of the swash plate. A first radial bearing is arranged between the housing and the drive shaft proximal to the first cylinder bore. A second radial bearing is arranged between the housing and the drive shaft proximal to the second cylinder bore. The actuator is arranged in the swash plate chamber to be rotatable integrally with the drive shaft. The actuator includes a movable body coupled to the swash plate, a fixed body fixed to the drive shaft, and a control pressure chamber defined by the movable body and the fixed body. The movable body includes a main portion and a circumferential wall. The main portion includes an insertion hole through which the drive shaft is inserted to allow the movable body to move in a direction along the rotation axis. The circumferential wall is formed integrally with the main portion and extended in the direction along the rotation axis to surround the fixed body. The actuator is configured to move the movable body with an interior pressure of the control pressure chamber. The housing includes an accommodation wall capable of accommodating the movable body. The circumferential wall and the fixed body are arranged to be spaced by a first clearance. The drive shaft and a wall defining the insertion hole are arranged to be spaced by a second clearance. The circumferential wall and the accommodation wall are arranged to be spaced by a third clearance. The drive shaft and the first radial bearing are arranged to be spaced by a fourth clearance. The drive shaft and the second radial bearing are arranged to be spaced by a fifth clearance. The first clearance differs in size from the second clearance, while a sum of the third clearance and the smaller one of the first and second clearances is larger than the fourth clearance and the fifth clearance to limit application of a radial load to the movable body when the drive shaft is displaced in a radial direction.

In the compressor according to the present invention, the first radial bearing and the second radial bearing are arranged between the housing and the drive shaft, the fourth clearance exists between the drive shaft and the first radial bearing, and the fifth clearance exists between the drive shaft and the second radial bearing. Thus, in the compressor, radial load displaces the drive shaft in the radial direction near the first cylinder bore by an amount corresponding to the fourth clearance, which exists between the drive shaft and the first radial bearing. Further, in the compressor, radial load displaces the drive shaft in the radial direction near the second cylinder bore by an amount corresponding to the fifth clearance, which exists between the drive shaft and the second radial bearing.

The compressor also includes the first clearance, which exists between the circumferential wall and the fixed body, the second clearance, which exists between the drive shaft and the wall defining the insertion hole, and the third clearance, which exists between the circumferential wall and the accommodation wall. Further, in the compressor, the first clearance differs from the second clearance in size. Further, the sum of the third clearance and the smaller one of the first and second clearances is larger than the fourth clearance and the fifth clearance. Thus, even when the drive shaft is displaced in the radial direction, the application of radial load to the movable body is limited.

Thus, in the compressor, interference of the circumferential wall of the movable body with the fixed body or the accommodation wall is limited, and the application of excessive friction force to between the drive shaft and the movable body and between the movable body and the accommodation wall is limited. Further, interference of the drive shaft with the wall defining the insertion hole in the movable body is limited, and the application of excessive friction force between the drive shaft and the movable body is limited. Thus, in the compressor, the movable body smoothly moves in the axial direction, and high controllability is obtained for varying the compressor displacement.

Further, in the compressor, when the movable body moves, the movable body does not have to overcome the friction force produced between the movable body and the fixed body and between the movable body and the accommodation wall in addition to the friction force produced between the movable body and the drive shaft. Thus, the compressor displacement may be increased within a short period of time, and cooling delays are limited. Further, the control pressure chamber and the like of the compressor do not have to be enlarged. This limits enlargement of the compressor and allows the compressor to be easily installed in a vehicle or the like.

Accordingly, the compressor according to the present invention readily increases and decreases the compressor displacement while improving the controllability and allowing for reduction in size.

Preferably, the third clearance is larger than the first clearance and the second clearance, while a difference of the third clearance and the smaller one of the first and second clearances is larger than the fourth clearance and the fifth clearance to limit contact of the circumferential wall and the accommodation wall when the drive shaft is displaced in the radial direction.

This ensures that interference of the circumferential wall of the movable body with the accommodation wall is limited when the drive shaft is displaced in the radial direction. Thus, in the compressor, the movable body may smoothly move in the axial direction, and high controllability is achieved when varying the compressor displacement.

Preferably, the third clearance is smaller than the first clearance and the second clearance, a difference of the first clearance and the third clearance is larger than the fourth clearance and the fifth clearance, and a difference of the second clearance and the third clearance is larger than the fourth clearance and the fifth clearance to limit contact of the circumferential wall and the fixed body when the drive shaft is displaced in the radial direction.

This ensures that interference of the circumferential wall of the movable body with the fixed body is limited when the drive shaft is displaced in the radial direction. Thus, in the compressor, the movable body may smoothly move in the axial direction, and high controllability is achieved when varying the compressor displacement.

Preferably, a slide layer is formed on at least one of the movable body and the fixed body to reduce slide resistance between the movable body and the fixed body.

Preferably, a slide layer is formed on at least one of the movable body and the accommodation wall to reduce slide resistance between the movable body and the accommodation wall.

In these cases, the movable body may be smoothly moved in the axial direction, for example, even when tolerance or the like results in interference between the circumferential wall and the fixed body and interference between the circumferential wall and the accommodation wall. This allows for improvement in the controllability for varying the compressor displacement. Further, in the compressor, the slide layer improves the durability of the movable body, the fixed body, and the accommodation wall.

Further, the slide layer may be tin plating. The slide layer may also be formed by applying fluorine resin or the like. Moreover, if the movable body and the like are made of aluminum alloy, alumite processing may be performed on the movable body and guide portion to form the slide layer.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First and second embodiments of the present invention will now be described with reference to the drawings. Compressors of the first and second embodiments are variable displacement double-headed swash plate compressors. The compressors are each installed in a vehicle and form a refrigeration circuit of a vehicle air conditioner.

First Embodiment

Figure 1:
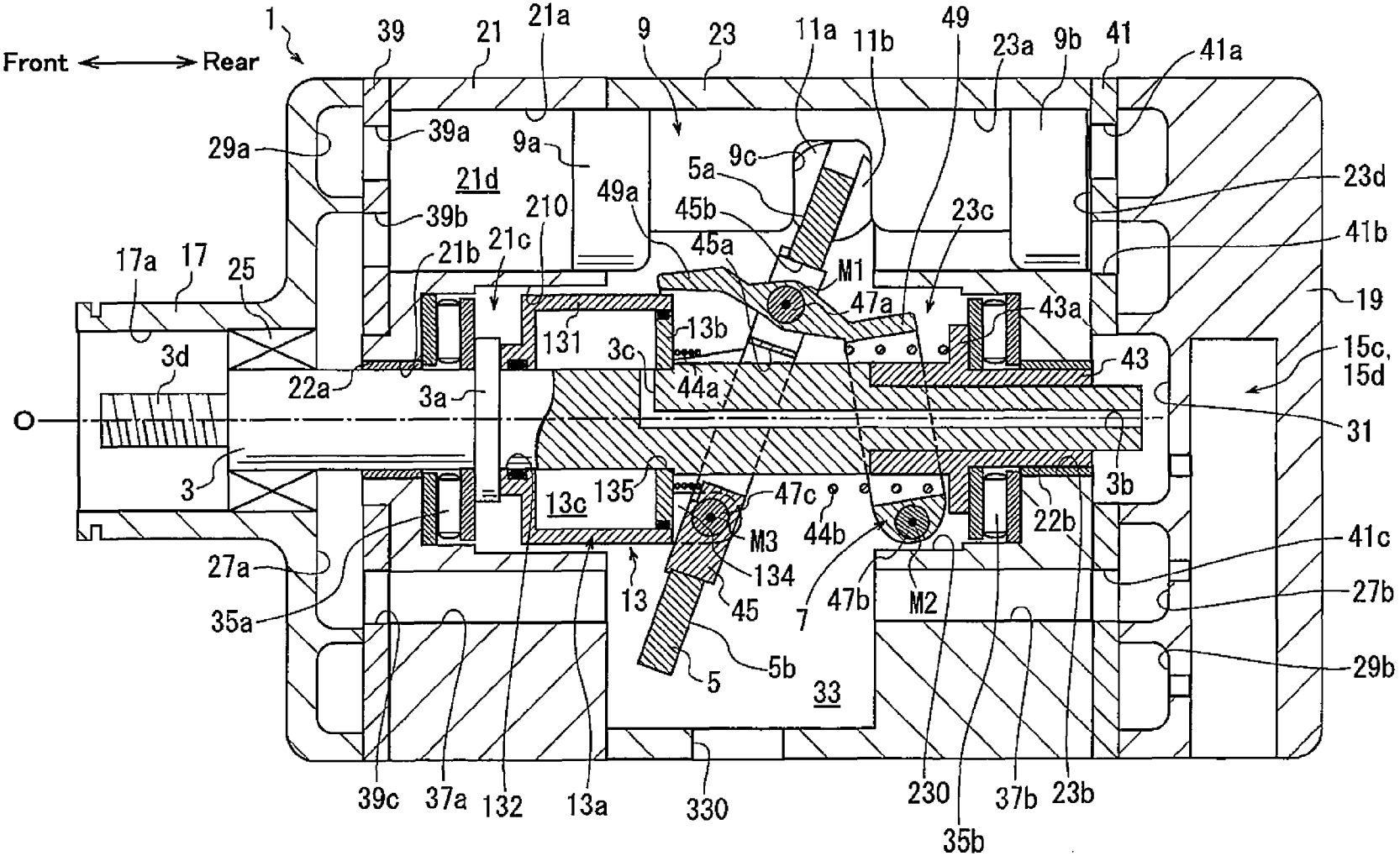
FIG. 1 is a cross-sectional view of a compressor according to a first embodiment of the present invention when the compressor displacement is maximal.
Figure 2:
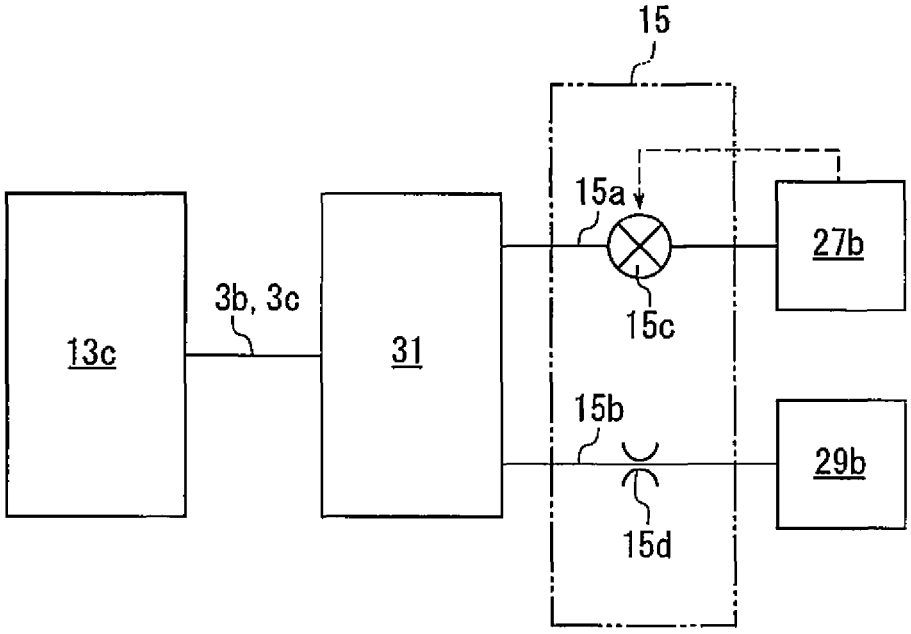
FIG. 2 is a schematic view of a control mechanism for the compressor shown in FIG. 1.

As shown in FIG. 1, the compressor includes a housing 1, a drive shaft 3, a swash plate 5, a link mechanism 7, a plurality of pistons 9, pairs of shoes 11*a* and 11*b*, an actuator 13, and a control mechanism 15, which is shown in FIG. 2.

As shown in FIG. 1, the housing 1 includes a front housing segment 17, which is located at the front of the compressor, a rear housing segment 19, which is located at the rear of the compressor, and a first cylinder block 21 and a second cylinder block 23, which are located between the front housing segment 17 and the rear housing segment 19.

A boss 17*a* extends toward the front from the front housing segment 17. A shaft seal device 25 is located in the boss 17*a* between the boss 17*a* and the drive shaft 3. A first suction chamber 27*a* and a first discharge chamber 29*a* are formed in the front housing segment 17. The first suction chamber 27*a* is located at the radially inner side of the front housing segment 17, and the first discharge chamber 29*a* is located at the radially outer side of the front housing segment 17.

The control mechanism 15 is arranged in the rear housing segment 19. A second suction chamber 27*b*, a second discharge chamber 29*b*, and a pressure adjustment chamber 31 are formed in the rear housing segment 19. The second suction chamber 27*b* is located at the radially inner side of the rear housing segment 19, and the second discharge chamber 29*b* is located at the radially outer side of the rear housing segment 19. The pressure adjustment chamber 31 is located at the central portion of the rear housing segment 19. A discharge passage (not shown) connects the first discharge chamber 29*a* and the second discharge chamber 29*b*. The discharge passage includes a discharge port (not shown), which connects the discharge passage to the outer side of the compressor.

A swash plate chamber 33 is formed between the first cylinder block 21 and the second cylinder block 23. The swash plate chamber 33 is located at the middle portion of the housing 1 with respect to the longitudinal direction of the compressor.

The first cylinder block 21 includes parallel first cylinder bores 21*a* arranged at equal angular intervals. The first cylinder block 21 also includes a first shaft hole 21*b*, into which the drive shaft 3 is fitted. A first slide bearing 22*a* is arranged in the first shaft hole 21*b*. The first slide bearing 22*a* corresponds to the first radial bearing of the present invention. A rolling bearing may be arranged in place of the first slide bearing 22*a*.

The first cylinder block 21 includes a first accommodation chamber 21*c*, which is connected to the first shaft hole 21*b* and coaxial with the first shaft hole 21*b*. A first accommodation wall 210, which is a portion of the first cylinder block 21, surrounds the first accommodation chamber 21*c* and partitions the first accommodation chamber 21*c* from the first cylinder bores 21*a*. The first accommodation wall 210 corresponds to the accommodation wall of the present invention. The first accommodation chamber 21*c* is connected to the swash plate chamber 33. Further, the first accommodation chamber 21*c* is shaped so that the diameter of the first accommodation chamber 21*c* decreases in a stepped manner toward the front end. A first thrust bearing 35*a* is arranged at the front end of the first accommodation chamber 21*c*. Further, the first cylinder block 21 includes a first suction passage 37*a*, which connects the swash plate chamber 33 and the first suction chamber 27*a*.

In the same manner as the first cylinder block 21, the second cylinder block 23 includes second cylinder bores 23*a*. The second cylinder block 23 also includes a second shaft hole 23*b*, into which the drive shaft 3 is fitted. The second shaft hole 23*b* is connected to the pressure adjustment chamber 31. A second slide bearing 22*b* is arranged in the second shaft hole 23*b*. The second slide bearing 22*b* corresponds to the second radial bearing of the present invention. A rolling bearing may be arranged in place of the second slide bearing 22*b*.

The second cylinder block 23 also includes a second accommodation chamber 23*c*, which is connected to the second shaft hole 23*b* and coaxial with the second shaft hole 23*b*. A second accommodation wall 230, which is a portion of the second cylinder block 23, surrounds the second accommodation chamber 23*c* and partitions the second accommodation chamber 23*c* from the second cylinder bores 23*a*. The second accommodation chamber 23*c* is also connected to the swash plate chamber 33. The second accommodation chamber 23*c* is shaped so that the diameter of the second accommodation chamber 23*c* decreases in a stepped manner toward the rear end. A second thrust bearing 35*b* is arranged at the rear end of the second accommodation chamber 23*c*. Further, the second cylinder block 23 includes a second suction passage 37*b* that connects the swash plate chamber 33 and the second suction chamber 27*b*.

Further, the second cylinder block 23 includes a suction port 330 connecting the swash plate chamber 33 to an evaporator (not shown).

A first valve plate 39 is arranged between the front housing segment 17 and the first cylinder block 21. The first valve plate 39 includes suction ports 39*b* and discharge ports 39*a*, the numbers of which is the same as the number of the first cylinder bores 21*a*. A suction valve mechanism (not shown) is arranged in each suction port 39*b* to connect the corresponding first cylinder bore 21*a* with the first suction chamber 27*a* through the suction port 39*b*. A discharge valve mechanism (not shown) is arranged in each discharge port 39*a* to connect the corresponding first cylinder bore 21*a* to the first discharge chamber 29*a* through the discharge port 39*a*. The first valve plate 39 also includes a communication hole 39*c* that connects the first suction chamber 27*a* and the first suction passage 37*a*.

A second valve plate 41 is arranged between the rear housing segment 19 and the second cylinder block 23. In the same manner as the first valve plate 39, the second valve plate 41 includes suction ports 41*b* and discharge ports 41*a*, the numbers of which are the same as number of the second cylinder bores 23*a*. A suction valve mechanism (not shown) is arranged in each suction port 41*b* to connect the corresponding second cylinder bore 23*a* with the second suction chamber 27*b* through the suction port 41*b*. A discharge valve mechanism (not shown) is arranged in each discharge port 41*a* to connect the corresponding second cylinder bore 23*a* to the second discharge chamber 29*b* through the discharge port 41*a*. The second valve plate 41 also includes a communication hole 41*c* that connects the second suction chamber 27*b* and the second suction passage 37*b*.

The first and second suction passages 37*a* and 37*b* and the communication holes 39*c* and 41*c* connect the first and second suction chambers 27*a* and 27*b* to the swash plate chamber 33. This substantially equalizes the pressure in the first and second suction chambers 27*a* and 27*b* with the pressure in the swash plate chamber 33. Refrigerant gas that passes through the evaporator and flows into the swash plate chamber 33 through the suction port 330 causes the pressure in the swash plate chamber 33 and the first and second suction chambers 27*a* and 27*b* to be lower than the pressure in the first and second discharge chambers 29*a* and 29*b*.

The swash plate 5, the actuator 13, and a flange 3*a* are each coupled to the drive shaft 3. The drive shaft 3 extends toward the rear from the boss 17*a* and is fitted into the first and second slide bearings 22*a* and 22*b*. This supports the drive shaft 3 rotatably about the rotation axis O. The drive shaft 3 is fitted into the housing 1 so that that the swash plate 5, the actuator 13, and the flange 3*a* are each located in the swash plate chamber 33.

A support 43 is press-fitted to the rear end of the drive shaft 3. The support 43 includes a flange 43*a*, which contacts the second thrust bearing 35*b*, and a coupling portion (not shown), into which a second pin 47*b* is fitted. Further, the rear end of a second recovery spring 44*b* is fixed to the support 43. The second recovery spring 44*b* extends toward the swash plate chamber 33 from the support 43 in the direction of axis O.

Figure 3:
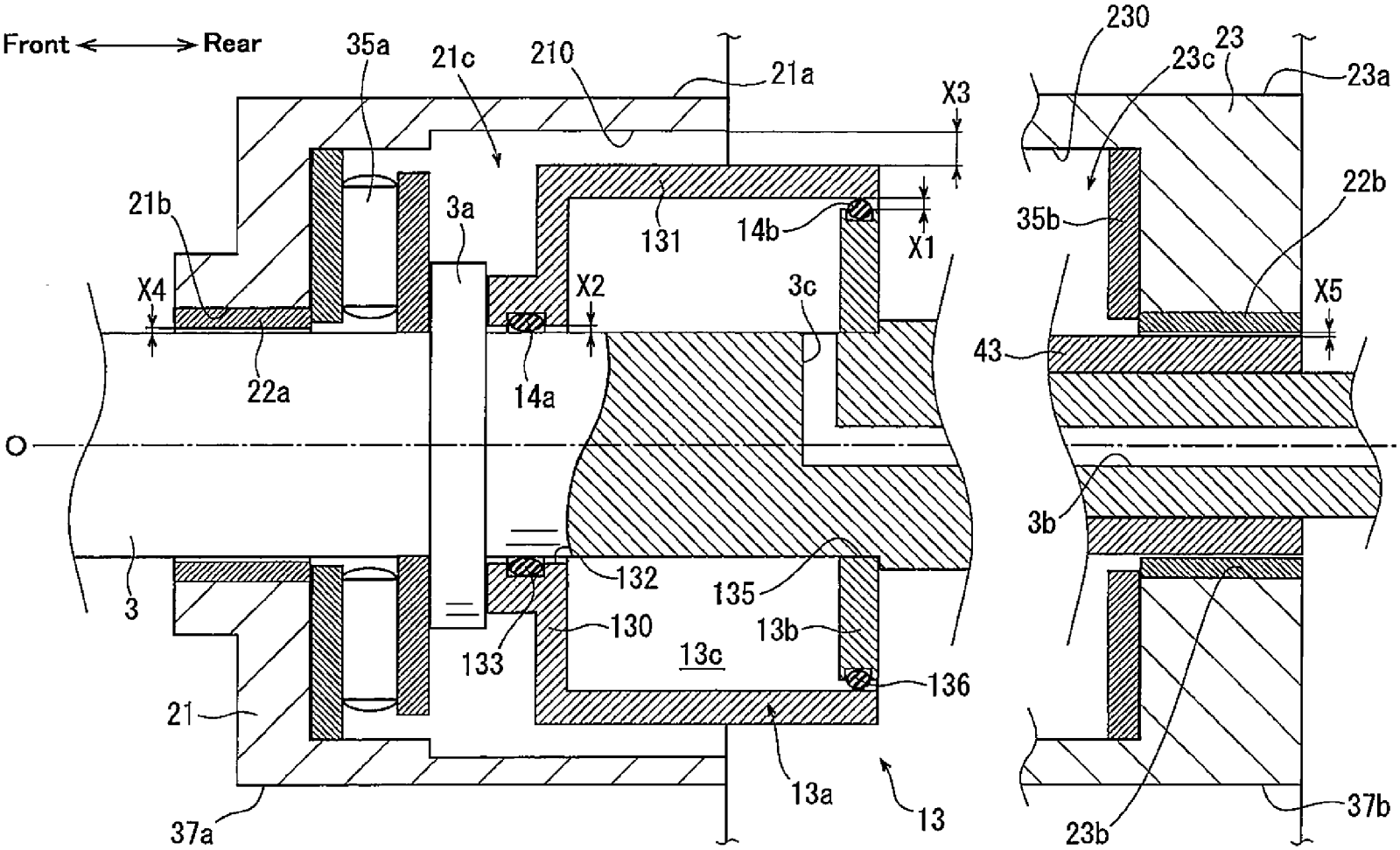
FIG. 3 is a partially enlarged cross-sectional view of first to fifth clearances in the compressor shown in FIG. 1.

Referring to FIG. 3, when the first and second slide bearings 22*a* and 22*b* are fitted to the drive shaft 3 in the compressor, a fourth clearance X4 exists between the drive shaft 3 and the first slide bearing 22*a*. A fifth clearance X5 exists between the drive shaft 3 and the second slide bearing 22*b*, more specifically, between the support 43 and the second slide bearing 22*b*. The fourth and fifth clearances X4 and X5 will be described in detail later.

As shown in FIG. 1, the drive shaft 3 includes an axial passage 3*b*, which extends in the direction of axis O from the rear end toward the front, and a radial passage 3*c*, which extends in the radial direction from the front end of the axial passage 3*b* and opens in the outer surface of the drive shaft 3. The axial passage 3*b* and the radial passage 3*c* form a communication passage. The rear end of the axial passage 3*b* opens in the pressure adjustment chamber 31. The radial passage 3*c* opens in the control pressure chamber 13*c*.

A threaded portion 3*d* is formed at the distal end of the drive shaft 3. A pulley or an electromagnetic clutch (not shown) is coupled to the threaded portion 3*d* and connected to the drive shaft 3. A belt (not shown), which is driven by the engine of the vehicle, runs along the pulley or the pulley of the electromagnetic clutch.

The swash plate 5, which is annular and flat, includes a front surface 5*a* and a rear surface 5*b*. The front surface 5*a* faces the front side of the compressor in the swash plate chamber 33. The rear surface 5*b* faces the rear side of the compressor in the swash plate chamber 33. The swash plate 5 is fixed to a ring plate 45. An insertion hole 45*a* extends through the central portion of the ring plate 45, which is annular and flat. The swash plate 5 is coupled to the drive shaft 3 in the swash plate chamber 33 by inserting the drive shaft 3 through the insertion hole 45*a*.

Figure 4:
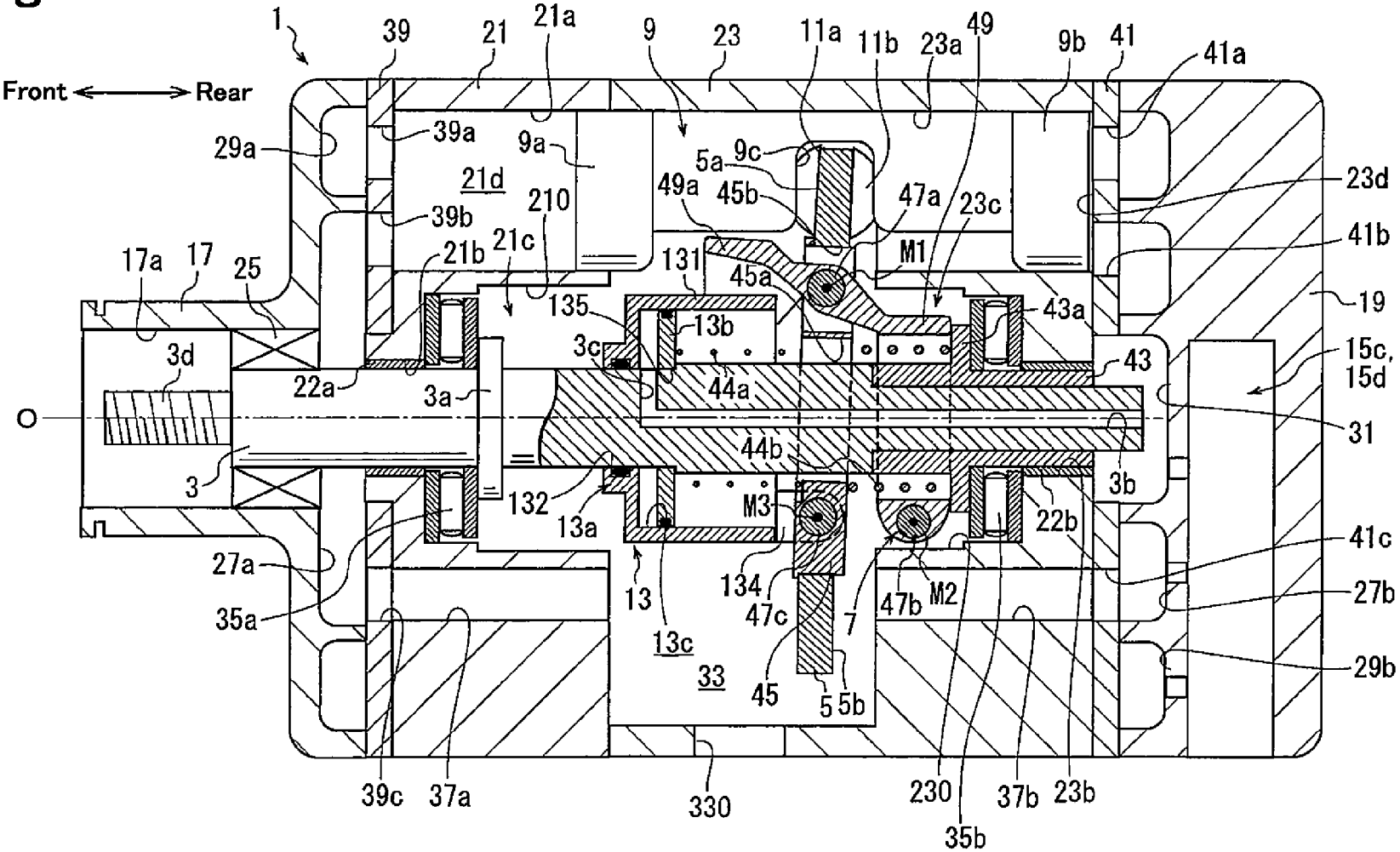
FIG. 4 is a cross-sectional view of the compressor shown in FIG. 1 when the compressor displacement is minimal.

The link mechanism 7 includes a lug arm 49 located at the rear of the swash plate 5 between the swash plate 5 and the support 43 in the swash plate chamber 33. The lug arm 49 is formed to be substantially L-shaped as viewed from the front end toward the rear end. As shown in FIG. 4, the lug arm 49 contacts the flange 43*a* of the support 43 when the inclination angle of the swash plate 5 is minimal relative to the rotation axis O. The lug arm 49 allows the swash plate 5 to be maintained at a minimum inclination angle in the compressor. A weight 49*a* is formed at the front end of the lug arm 49. The weight 49*a* extends around substantially one half of the actuator 13 in the circumferential direction. The weight 49*a* may be designed to have a suitable shape.

A first pin 47*a* connects the front end of the lug arm 49 to one radial side of the ring plate 45. This supports one end of the lug arm 49 to be tiltable about the axis of the first pin 47*a*, or the first tilt axis M1, relative to one side of the ring plate 45, that is, the swash plate 5. The first tilt axis M1 extends in a direction orthogonal to the rotation axis O of the drive shaft 3.

The second pin 47*b* connects the rear end of the lug arm 49 to the support 43. This support the other end of the lug arm 49 to be tiltable about the axis of the second pin 47*b*, or the second tilt axis M2, relative to the support 43, that is, the drive shaft 3. The second tilt axis M2 extends parallel to the first tilt axis M1. The lug arm 49 and the first and second pins 47*a* and 47*b* form the link mechanism 7 of the present invention.

The weight 49*a* is arranged to extend from one end of the lug arm 49, or the first tilt axis M1, toward the side opposite to the second tilt axis M2. The lug arm 49 is supported by the ring plate 45 with the first pin 47*a* so that the weight 49*a* extends through a groove 45*b* of the ring plate 45 and is located on the front surface of the ring plate 45, that is, the front surface 5*a* of the swash plate 5. The centrifugal force generated when the swash plate 5 rotates about the rotation axis O acts on the weight 49*a* at the front surface 5*a* of the swash plate 5.

In the compressor, the link mechanism 7 connects the swash plate 5 and the drive shaft 3 so that the swash plate 5 is rotatable with the drive shaft 3. The two ends of the lug arm 49 are respectively tilted about the first tilt axis M1 and the second tilt axis M2 to change the inclination angle of the swash plate 5.

Each piston 9 includes a first piston head 9*a*, which is formed on the front end, and a second piston head 9*b*, which is formed on the rear end. The first piston head 9*a* reciprocates in the first cylinder bore 21*a* and forms a first compression chamber 21*d*. The second piston head 9*b* reciprocates in the second cylinder bore 23*a* and forms a second compression chamber 23*d*. A piston recess 9*c* is formed in the middle of each piston 9. Each piston recess 9*c* accommodates a pair of the semispherical shoes 11*a* and 11*b* to convert the rotation of the swash plate 5 to reciprocation of the piston 9. The shoes 11*a* and 11*b* form the conversion mechanism of the present invention. The first and second piston heads 9*a* and 9*b* respectively reciprocate in the first and second cylinder bores 21*a* and 23*a* with a stroke corresponding to the inclination angle of the swash plate 5.

The actuator 13 is arranged in the swash plate chamber 33 and located in front of the swash plate 5, and movable into the first accommodation chamber 21*c*. When the actuator 13 is arranged in the first accommodation chamber 21*c*, the actuator 13 is accommodated by the first accommodation wall 210. As shown in FIG. 3, the actuator 13 includes a movable body 13*a*, a fixed body 13*b*, and a control pressure chamber 13*c*. The control pressure chamber 13*c* is formed between the movable body 13*a* and the fixed body 13*b*.

The movable body 13*a* includes a main portion 130 and a circumferential wall 131. The main portion 130 is located at the front of the movable body 13*a* and extends away from the rotation axis O in the radial direction. An insertion hole 132 extends through the main portion 130, and a ring groove 133 is formed in the wall of the insertion hole 132. An O-ring 14*a* is received in the ring groove 133.

The circumferential wall 131 is continuous with the outer edge of the main portion 130 and extends toward the rear. Further, as shown in FIG. 1, the rear end of the circumferential wall 131 includes coupling portions 134. Each of the coupling portions 134 extends toward the rear of the movable body 13*a* from the rear end of the circumferential wall 131. The main portion 130, the circumferential wall 131, and the coupling portions 134 form the movable body 13*a* so that the movable body 13*a* is cylindrical and has a closed end.

As shown in FIG. 3, the fixed body 13*b* has the form of a circular plate and has substantially the same diameter as the inner diameter of the movable body 13*a*. An insertion hole 135 extends through the center of the fixed body 13*b*. Further, a ring groove 136 is formed in the circumferential surface of the fixed body 13*b*. An O-ring 14*b* is received in the ring groove 136.

Figure 5:
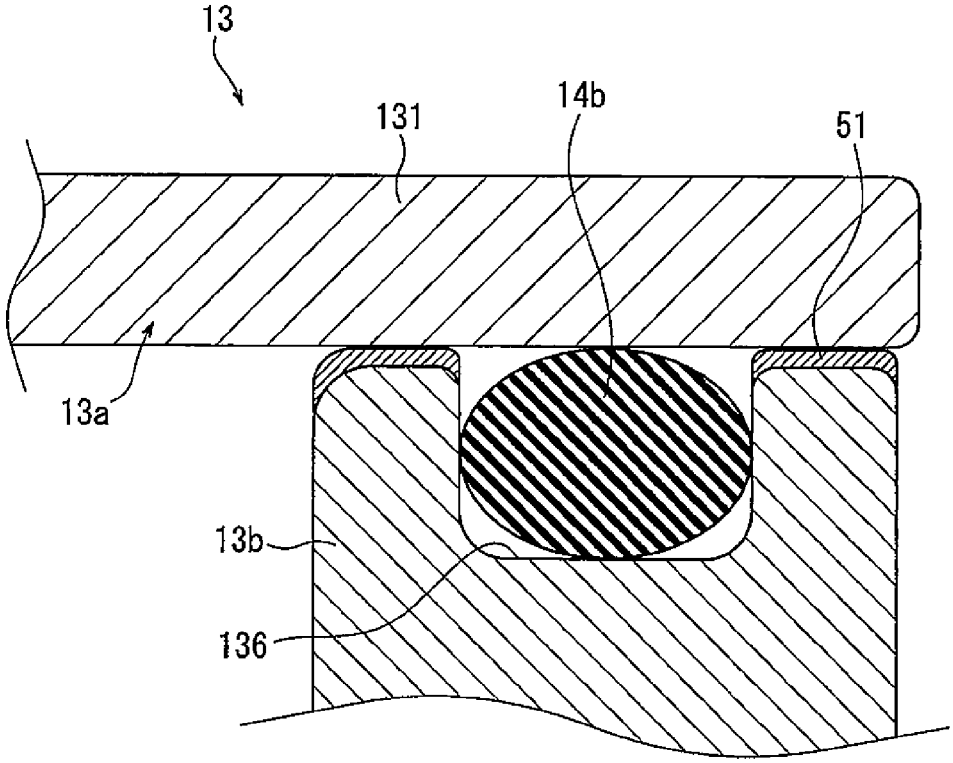
FIG. 5 is a partially enlarged cross-sectional view of a slide layer in the compressor shown in FIG. 1.

As shown in FIG. 5, a slide layer 51, which is tin plating, is applied to the circumferential surface of the fixed body 13*b*.

As shown in FIG. 1, the drive shaft 3 is fitted to the movable body 13*a* and the fixed body 13*b* through the insertion holes 132 and 135. Thus, the fixed body 13*b* is accommodated by the first accommodation wall 210, and the movable body 13*a* and the link mechanism 7 are arranged on opposite sides of the swash plate 5. The fixed body 13*b* is located in the movable body 13*a* in front of the swash plate 5 and surrounded by the circumferential wall 131. This forms the control pressure chamber 13*c* between the movable body 13*a* and the fixed body 13*b*. The control pressure chamber 13*c* is defined in the swash plate chamber 33 by the main portion 130 and the circumferential wall 131 of the movable body 13*a* and the fixed body 13*b*. As described above, the radial passage 3*c* is open to the control pressure chamber 13*c*, and the control pressure chamber 13*c* is connected to the pressure adjustment chamber 31 through the radial passage 3*c* and the axial passage 3*b*.

When the drive shaft 3 is fitted to the movable body 13*a*, the movable body 13*a* is rotatable with the drive shaft 3 and movable in the direction of axis O of the drive shaft 3 inside the swash plate chamber 33. The fixed body 13*b*, when fitted to the drive shaft 3, is fixed to the drive shaft 3. Thus, the fixed body 13*b* is able to rotate only with the drive shaft 3 and cannot move like the movable body 13*a*. As a result, when the movable body 13*a* moves in the direction of the rotation axis O, the movable body 13*a* moves relative to the fixed body 13*b*.

Referring to FIG. 3, in the compressor, when the drive shaft 3 is inserted through the fixed body 13*b* and the movable body 13*a* with the fixed body 13*b* arranged in the movable body 13*a*, a first clearance X1 exists between inner surface of the circumferential wall 131 of the movable body 13*a* and the circumferential surface of the fixed body 13*b*. Further, a second clearance X2 exists between the drive shaft 3 and the wall of the insertion hole 132 in the movable body 13*a*. Further, when the actuator 13 is accommodated by the first accommodation wall 210, a third clearance X3 exists between the outer surface of the circumferential wall 131 and the first accommodation wall 210.

In the compressor, the movable body 13*a* and the fixed body 13*b* are designed so that the first clearance X1 is larger than the second clearance X2. Further, the accommodation chamber 21*c* is designed with a size that results in the third clearance X3 being larger than the first clearance X1 and the second clearance X2. Moreover, the support 43 is designed with a size that results in the fourth clearance X4 being larger than the fifth clearance X5.

Figure 6:
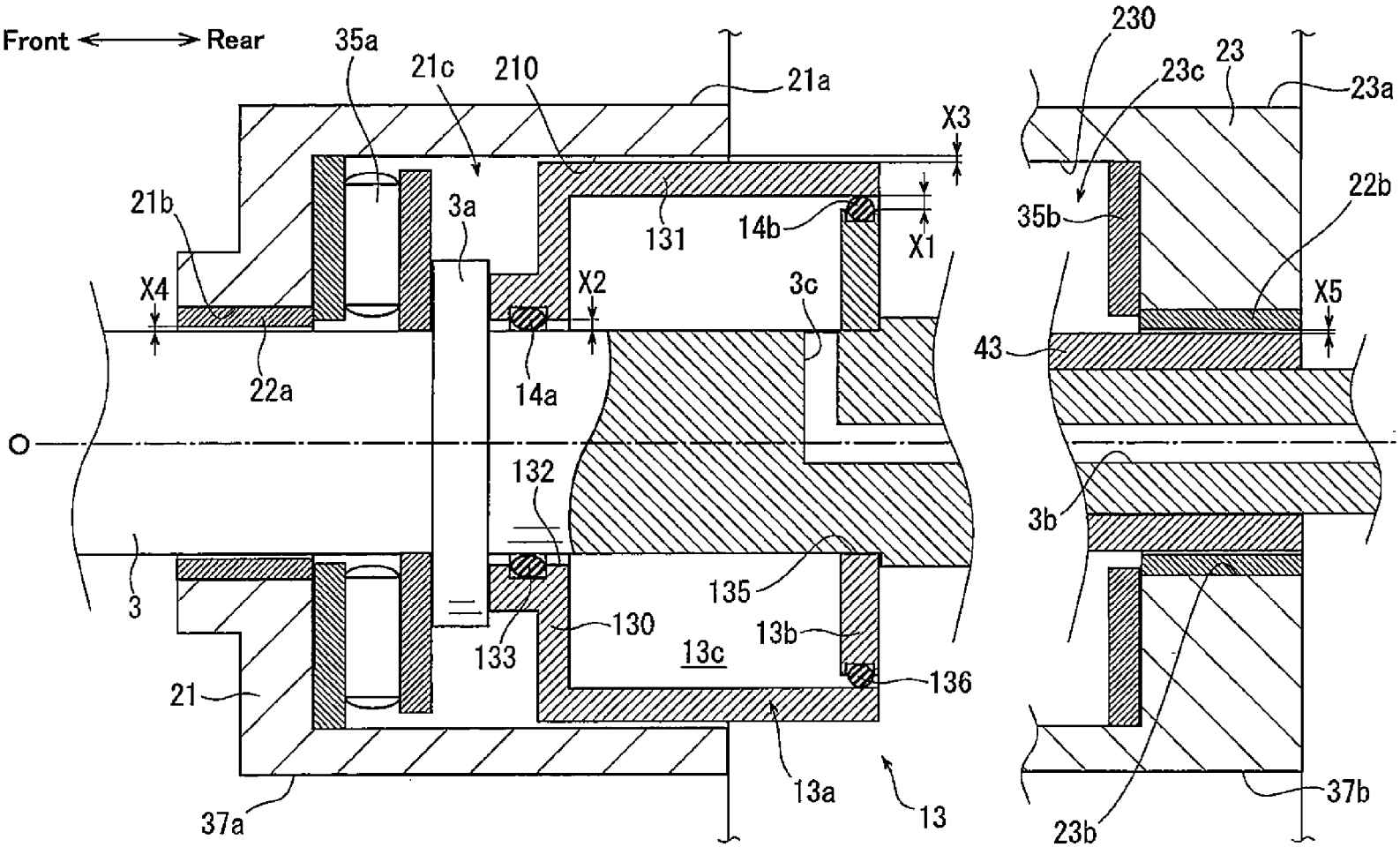
FIG. 6 is a partially enlarged cross-sectional view of first to fifth clearances in a compressor according to a second embodiment of the present invention.

The movable body 13*a*, the fixed body 13*b*, and the like are designed so that the sum of the second clearance X2 and the third clearance X3 is larger than any one of the fourth clearance X4 and the fifth clearance X5 and so that the difference between the third clearance X3 and the second clearance X2 is larger than any one of the fourth clearance X4 and the fifth clearance X5. In FIG. 3, to facilitate illustration, the first to fifth clearances X1 to X5 are not shown in scale. Further, the coupling portions 134 and the like are not shown in FIG. 3. FIG. 6 is also not shown in scale and does not show the coupling portions 134 and the like.

As shown in FIG. 1, each coupling portion 134 of the movable body 13*a* is connected to the other radial side of the ring plate 45 by a third pin 47*c*. The axis of the third pin 47*c* serves as an operation axis M3, and the movable body 13*a* supports the other side of the ring plate 45, that is, the swash plate 5, to be tiltable about the operation axis M3. The operation axis M3 extends parallel to the first and second tilt axes M1 and M2. In this manner, the movable body 13*a* is coupled to the swash plate 5. The movable body 13*a* contacts the flange 3*a* when the inclination angle of the swash plate 5 is maximal.

A first recovery spring 44*a* is arranged between the fixed body 13*b* and the ring plate 45. The front end of the first recovery spring 44*a* is fixed to the fixed body 13*b*, and the rear end of the first recovery spring 44*a* is fixed to the other side of the ring plate 45.

As shown in FIG. 2, the control mechanism 15 includes a bleeding passage 15*a*, an air supply passage 15*b*, a control valve 15*c*, and an orifice 15*d*.

The bleeding passage 15*a* is connected to the pressure adjustment chamber 31 and the second suction chamber 27*b*. Thus, the bleeding passage 15*a*, the axial passage 3*b*, and the radial passage 3*c* connect the control pressure chamber 13*c*, the pressure adjustment chamber 31, and the second suction chamber 27*b*. The air supply passage 15*b* is connected to the pressure adjustment chamber 31 and the second discharge chamber 29*b*. The air supply passage 15*b*, the axial passage 3*b*, and the radial passage 3*c* connect the control pressure chamber 13*c*, the pressure adjustment chamber 31, and the second discharge chamber 29*b*. The orifice 15*d* is located in the air supply passage 15*b* to restrict the amount of refrigerant gas flowing through the air supply passage 15*b*.

The control valve 15*c* is arranged in the bleeding passage 15*a*. The control valve 15*c* adjusts the opening of the bleeding passage 15*a* based on the pressure in the second suction chamber 27*b* to adjust the amount of the refrigerant gas flowing through the bleeding passage 15*a*.

In the compressor, a pipe connects the evaporator to the suction port 330 shown in FIG. 1, and a pipe connects a condenser to the discharge port. The condenser is connected to the evaporator by a pipe and an expansion valve. The compressor, the evaporator, the expansion valve, the condenser, and the like form a refrigeration circuit of the vehicle air conditioner. The evaporator, the expansion valve, the condenser, and each pipe are not shown in the drawings.

In the compressor, the swash plate 5 is rotated and each piston 9 is reciprocated in the corresponding first and second cylinder bores 21*a* and 23*a* when the drive shaft 3 is rotated. Thus, displacement of the first and second compression chambers 21*d* and 23*d* are varied in accordance with the piston stroke. The refrigerant gas drawn into the swash plate chamber 33 from the evaporator through the suction port 330 flows through the first and second suction chambers 27*a* and 27*b* to be compressed in each of the first and second compression chambers 21*d* and 23*d* and is then discharged into the first and second discharge chambers 29*a* and 29*b*. The refrigerant gas in the first and second discharge chambers 29*a* and 29*b* is discharged out of the discharge port to the condenser.

During the operation of the compressor, a piston compression force that decreases the inclination angle of the swash plate 5 acts on a rotating body formed by the swash plate 5, the ring plate 45, the lug arm 49, and the first pin 47*a*. A change in the inclination angle of the swash plate 5 allows for displacement control to be executed by increasing and decreasing the stroke of the piston 9.

Specifically, in the control mechanism 15, when the control valve 15*c* shown in FIG. 2 increases the amount of the refrigerant gas flowing through the bleeding passage 15*a*, less refrigerant gas from the second discharge chamber 29*b* is accumulated in the pressure adjustment chamber 31 through the air supply passage 15*b* and the orifice 15*d*. Thus, the pressure of the control pressure chamber 13*c* becomes substantially equal to the second suction chamber 27*b*. As a result, the piston compression force acting on the swash plate 5 moves the actuator 13, as shown in FIG. 4. This moves the movable body 13*a* moves toward the rear in the swash plate chamber 33, that is, out of the first accommodation chamber 21*c* and toward the lug arm 49.

Consequently, the lower side of the ring plate 45, that is, the lower side of the swash plate 5 is tilted in the counterclockwise direction about the operation axis M3 by the urging force of the first recovery spring 44*a*. One end of the lug arm 49 is tilted in the clockwise direction about the first tilt axis M1 and the other end of the lug arm 49 is tilted in the clockwise direction about the second tilt axis M2. Thus, the lug arm 49 approaches the flange 43*a* of the support 43. The swash plate 5 is thus tilted with the operation axis M3 functioning as the operation point and the first tilt axis M1 functioning as the fulcrum point. This decreases the inclination angle of the swash plate 5 relative to the rotation axis O of the drive shaft 3 and decreases the stroke of the pistons 9 thereby decreasing the suction and discharge displacement for each drive shaft rotation of the compressor. FIG. 4 shows the swash plate 5 at the minimum inclination angle in the compressor. When the swash plate 5 reaches the minimum inclination angle, the movable body 13*a* is located in the swash plate chamber 33 outside the first accommodation chamber 21*c*.

In the compressor, the centrifugal force acting on the weight 49*a* is also applied to the swash plate 5. Thus, in the compressor, the swash plate 5 can easily be moved in the direction that decreases the inclination angle. Further, the movable body 13*a* moves toward the rear in the swash plate chamber 33. This positions the rear end of the movable body 13*a* in the weight 49*a*. Thus, in the compressor, about one half of the rear end of the movable body 13*a* is covered by the weight 49*a* when the inclination angle of the swash plate 5 is decreased.

Further, the ring plate 45 contacts the front end of the second recovery spring 44*b* when the inclination angle of the swash plate 5 decreases. This elastically deforms the second recovery spring 44*b*, and the front end of the second recovery spring 44*b* approaches the support 43.

The refrigerant gas in the second discharge chamber 29*b* is easily accumulated in the pressure adjustment chamber 31 through the air supply passage 15*b* and the orifice 15*d* when the control valve 15*c* shown in FIG. 2 reduces the amount of the refrigerant gas flowing through the bleeding passage 15*a*. Thus, the pressure of the control pressure chamber 13*c* becomes substantially equal to the second discharge chamber 29*b*. This moves the actuator 13 against the piston compression force acting on the swash plate 5 so that the movable body 13*a* moves away from the lug arm 49 toward the front of the swash plate chamber 33, that is, into the first accommodation chamber 21*c*.

Consequently, in the compressor, the movable body 13*a* pulls the lower side of the swash plate 5 toward the front of the swash plate chamber 33 with the coupling portions 134 at the operation axis M3. This tilts the lower side of the swash plate 5 in the clockwise direction about the operation axis M3. Further, one end of the lug arm 49 is tilted in the counterclockwise direction about the first tilt axis M1, and the other end of the lug arm 49 is tilted in the counterclockwise direction about the second tilt axis M2. The lug arm 49 thus moves away from the flange 43*a* of the support 43. Thus, the swash plate 5 tilts in the direction opposite to when the inclination angle is decreased with the operation axis M3 and the first tilt axis M1 functioning as the operation point and the fulcrum point, respectively. This increases the inclination angle of the swash plate 5 relative to the rotation axis O of the drive shaft 3 thereby increasing the stroke of the piston 9 and increasing the suction and discharge displacement for each drive shaft rotation of the compressor. FIG. 1 shows the swash plate 5 at the maximum inclination angle in the compressor.

In this manner, in the compressor, the compression reaction force, discharge reaction force, and the like acting on each piston 9 produces a radial load that acts on the drive shaft 3. As shown in FIG. 3, the compressor includes the fourth clearance X4, existing between the drive shaft 3 and the first slide bearing 22*a*, and the fifth clearance X5, existing between the support 43 and the second bearing 22*b*. Thus, in the compressor, the radial load displaces the drive shaft 3 near the first cylinder bores 21*a* in the radial direction by an amount corresponding to the fourth clearance X4 from the first slide bearing 22*a*. Further, the radial load displaces the drive shaft 3 near the second cylinder bores 23*a* in the radial direction by an amount corresponding to the fifth clearance X5 from the second slide bearing 22*b*.

The compressor also includes the first clearance X1, existing between the inner surface of the circumferential wall 131 and the circumference surface of the fixed body 13*b*, and the second clearance X2, existing between the drive shaft 3 and the wall of the insertion hole 132 in the movable body 13*a*. The first clearance X1 is larger than the second clearance X2. Further, the third clearance X3, existing between the outer surface of the circumferential wall 131 and the first accommodation wall 210, is larger than each the first clearance X1 and the second clearance X2. The sum of the second clearance X2 and the third clearance X3 is larger than the fourth clearance X4 and the fifth clearance X5. The difference of the third clearance X3 and the second clearance X2 is larger than the fourth clearance X4 and the fifth clearance X5.

Accordingly, even when the drive shaft 3 is displaced in the radial direction, the application of radial load to the movable body 13*a* is limited. As a result, in the compressor, interference of the circumferential wall 131 of the movable body 13*a* with the fixed body 13*b* or the first accommodation wall 210 is limited. Thus, excessive friction force does not act between the movable body 13*a* and the fixed body 13*b*. Further, in the compressor, interference of the drive shaft 3 with the wall of the insertion hole 132 in the movable body 13*a* is limited. Thus, excessive friction force does not act between the wall of the insertion hole 132 and the movable body 13*a*.

In the compressor, even when displacement of the drive shaft 3 in the radial direction results in interference between the inner surface of the circumferential wall 131 and the circumferential surface of the fixed body 13*b* that is beyond the tolerable margin of the O-ring 14*b*, the outer surface of the circumferential wall 131 does not contact the first accommodation wall 210. Thus, the circumferential wall 131 and the first accommodation wall 210 do not interfere with each other. In the same manner, even when displacement of the drive shaft 3 in the radial direction results in interference between the drive shaft 3 and the wall of the insertion hole 132 that is beyond the tolerable margin of the O-ring 14*a*, the circumferential wall 131 does not contact the first accommodation wall 210. Thus, the movable body 13*a* and the first accommodation wall 210 do not interfere with each other.

In this manner, the compressor ensures that interference does not occur between the outer surface of the circumferential wall 131 of the movable body 13*a* and the first accommodation wall 210 when the drive shaft 3 is displaced in the radial direction. Thus, excessive friction force does not act between the outer surface of the circumferential wall 131 and the first accommodation wall 210. Accordingly, the movable body 13*a* smoothly moves in the direction of the rotation axis O, and the compressor has high controllability when varying the compressor displacement.

Further, in the compressor, in addition to the friction force produced between the movable body 13*a* and the fixed body 13*b* and the friction force produced between the movable body 13*a* and the first accommodation wall 210, the movable body 13*a* does not have to overcome the friction force produced between the movable body 13*a* and the drive shaft 3 when the movable body 13*a* moves. This allows the compressor displacement to be increased within a short period of time and limits cooling delays. Further, there is no need to enlarge the control pressure chamber 13*c* or the like in the compressor. Thus, enlargement of the compressor is limited, and the compressor may easily be installed in a vehicle or the like.

In the compressor, there is no need to enlarge the control pressure chamber 13*c*. This allows for reduction in the time for changing the volume of the control pressure chamber 13*c*. Thus, the compressor displacement may be readily varied in accordance with the driving condition of the vehicle in which the compressor is installed. Further, with the compressor, there is no need for an ECU or the like to execute a complicated control on the engine when varying the compressor displacement.

Accordingly, the compressor of the first embodiment allows for the compressor displacement to be readily increased and decreased while improving the controllability and allowing for reduction in size.

In particular, in the compressor, the slide layer 51 is formed on the circumferential surface of the fixed body 13*b*. This allows for the movable body 13*a* to smoothly move in the direction of the rotation axis O even when the inner surface of the circumferential wall 131 interferes with the fixed body 13*b* due to tolerance or the like. Further, in the compressor, the slide layer 51 increases the durability of the movable body 13*a* and the fixed body 13*b*.

Second Embodiment

In a compressor of the second embodiment, as shown in FIG. 6, the first accommodation chamber 21*c* is designed so that the third clearance X3 is smaller than the first clearance X1 and the second clearance X2. That is, in the compressor, the first accommodation chamber 21*c* is smaller than that in the compressor of the first embodiment.

In the compressor, the sum of the second clearance X2 and the third clearance X3 is larger than the fourth clearance X4 and the fifth clearance X5. Further, in the compressor, the difference of the first clearance X1 and the third clearance X3 is larger than the fourth clearance X4 and the fifth clearance X5. In the compressor, the difference of the second clearance X1 and the third clearance X3 is larger than the fourth clearance X4 and the fifth clearance X5.

Figure 7:
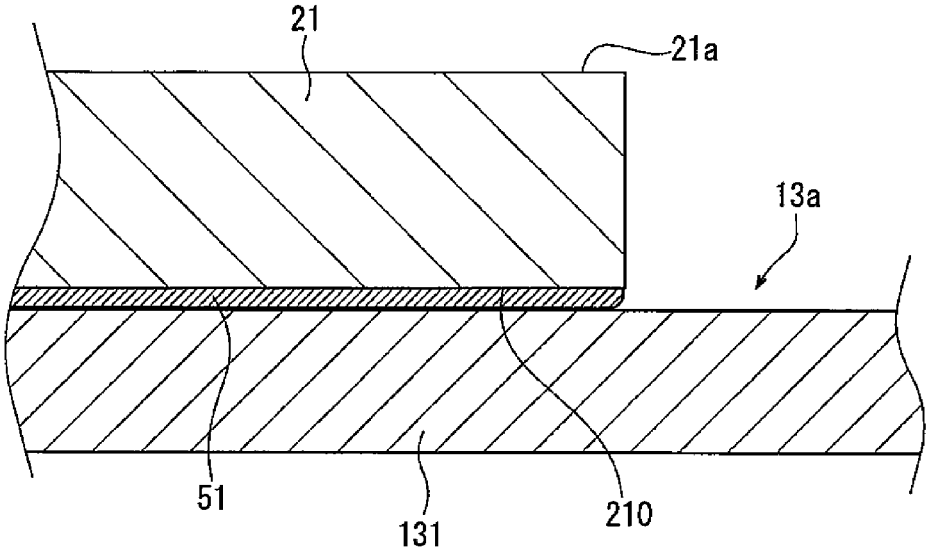
FIG. 7 is a partially enlarged cross-sectional view of a slide layer in the compressor shown in FIG. 6.

Further, as shown in FIG. 7, a slide layer 51, which is formed by tin plating, is formed on the first accommodation wall 210. The compressor differs from the compressor of the first embodiment in that the slide layer 51 is not formed on the circumferential surface of the fixed body 13*b*. Otherwise, the structure of the compressor is the same as the compressor of the first embodiment. Like or same reference numerals are given to those components that are the same as the corresponding components of the first embodiment. Such components will not be described in detail.

Referring to FIG. 6, in the compressor, radial load acting on the drive shaft 3 displaces the drive shaft 3 near the first cylinder bores 21*a* in the radial direction by an amount corresponding to the fourth clearance X4 from the first slide bearing 22*a*. Further, the radial load displaces the drive shaft 3 near the second cylinder bores 23*a* in the radial direction by an amount corresponding to the fifth clearance X5 from the second slide bearing 22*b*.

In the compressor, the first clearance X1 is larger than the second clearance X2. Further, the third clearance X3 is smaller than the first clearance X1 and the second clearance X2. The sum of the second clearance X2 and the third clearance X3 is larger than the fourth clearance X4 and the fifth clearance X5. The difference of the first clearance X1 and the third clearance X3 is larger than the fourth clearance X4 and the fifth clearance X5. Further, the sum of the second clearance X2 and the third clearance X3 is larger than the fourth clearance X4 and the fifth clearance X5.

Accordingly, when the drive shaft 3 is displaced in the radial direction, the application of radial load to the movable body 13*a* is limited. As a result, in the compressor, interference of the circumferential wall 131 of the movable body 13*a* with the fixed body 13*b* or the first accommodation wall 210 is limited. Thus, excessive friction force does not act between the movable body 13*a* and the fixed body 13*b*. Further, in the compressor, interference of the drive shaft 3 with the wall of the insertion hole 132 in the movable body 13*a* is limited. Thus, excessive friction force does not act between the wall of the insertion hole 132 and the movable body 13*a*.

In the compressor, even when displacement of the drive shaft 3 in the radial direction results in interference between the outer surface of the circumferential wall 131 of the movable body 13*a* and the first accommodation wall 210, the inner surface of the circumferential wall 131 does not contact the circumferential surface of the fixed body 13*b*. Thus, the circumferential wall 131 and the fixed body 13*b* do not interfere with each other. In the same manner, even when displacement of the drive shaft 3 in the radial direction results in interference between the outer surface of the circumferential wall 131 of the movable body 13*a* and the first accommodation wall 210, the drive shaft 3 does not contact the wall of the insertion hole 132. Thus, the drive shaft 3 and the wall of the insertion hole 132 do not interfere with each other.

In this manner, the compressor ensures that interference does not occur between the inner surface of the circumferential wall 131 of the movable body 13*a* and the fixed body 13*b* and between the drive shaft 3 and the wall of the insertion hole 132 in the movable body 13*a* when the drive shaft 3 is displaced in the radial direction. Accordingly, the movable body 13*a* smoothly moves in the direction of the rotation axis O, and the compressor has high controllability when varying the compressor displacement.

Further, in the compressor, the slide layer 51 is formed on the first accommodation wall 210. This allows for the movable body 13*a* to smoothly move in the direction of the rotation axis O even when, for example, the outer surface of the circumferential wall 131 interferes with the first accommodation wall 210 due to tolerance or the like. Further, in the compressor, the slide layer 51 increases the durability of the movable body 13*a* and the first cylinder block 21. The compressor has other advantages that are the same as the compressor of the first embodiment.

It should be apparent to those skilled in the art that the present invention may be embodied in many other specific forms without departing from the spirit or scope of the invention. Particularly, it should be understood that the present invention may be embodied in the following forms.

In the first and second embodiments, the cylinder bores may be arranged in only one of the first cylinder block 21 and the second cylinder block 23, and each piston 9 may be provided with only one of the first piston head 9*a* and the second piston head 9*b*. In other words, the present invention may be applied to a variable displacement single-head swash plate compressor.

In the control mechanism 15 of the first and second embodiments, the control valve 15*c* may be arranged in the air supply passage 15*b*, and the orifice 15*d* may be arranged in the bleeding passage 15*a*. In this case, the amount of the high pressure refrigerant flowing through the air supply passage 15*b* can be adjusted by the control valve 15*c*. Thus, the compressor displacement can be readily decreased by rapidly increasing the pressure of the control pressure chamber 13*c* with the high pressure of the second discharge chamber 29*b*.

In the first and second embodiments, the second clearance X2 may be larger than the first clearance X1. Further, the fifth clearance X5 may be larger than the fourth clearance X4.

In the first and second embodiments, the first clearance X1 may differ in size from the second clearance X2. Further, the sum of the third clearance X3 and the smaller one of the first clearance X1 and the second clearance X2 may be larger than the fourth clearance X4 and the fifth clearance X5.

In the first embodiment, the slide layer 51 may be formed on the inner surface of the circumferential wall 131 of the movable body 13*a*. Moreover, the slide layer 51 may be formed on the circumferential surface of the fixed body 13*b* and the inner surface of the circumferential wall 131. Further, in the first embodiment, the slide layer 51 may be formed on the outer surface of the circumferential wall 131 or on the first accommodation wall 210.

In the second embodiment, the slide layer 51 may be formed on the outer surface of the circumferential wall 131 of the movable body 13*a*. Moreover, the slide layer 51 may be formed on the first accommodation wall 210 and the outer surface of the circumferential wall 131. Further, in the second embodiment, the slide layer 51 may be formed on the inner surface of the circumferential wall 131 or on the circumferential surface of the fixed body 13*b*.

The present examples and embodiments are to be considered as illustrative and not restrictive, and the invention is not to be limited to the details given herein, but may be modified within the scope and equivalence of the appended claims.

The invention claimed is:

1. A variable displacement swash plate compressor comprising:

a housing including a suction chamber, a discharge chamber, a swash plate chamber, and a cylinder bore;

a drive shaft supported to be rotatable in the housing;

a swash plate that is rotatable in the swash plate chamber when the drive shaft rotates;

a link mechanism arranged between the drive shaft and the swash plate, wherein the link mechanism allows an inclination angle of the swash plate to be changed relative to a direction orthogonal to a rotation axis of the drive shaft;

a piston reciprocated in the cylinder bore;

a conversion mechanism that reciprocates the piston in the cylinder bore with a stroke corresponding to the inclination angle when the swash plate rotates;

an actuator capable of changing the inclination angle; and a control mechanism that controls the actuator, wherein the cylinder bore includes a first cylinder bore, located at one side of the swash plate, and a second cylinder bore, located at an opposite side of the swash plate, a first radial bearing is arranged between the housing and the drive shaft proximal to the first cylinder bore, a second radial bearing is arranged between the housing and the drive shaft proximal to the second cylinder bore, the actuator is arranged in the swash plate chamber to be rotatable integrally with the drive shaft, the actuator includes a movable body coupled to the swash plate, a fixed body fixed to the drive shaft, and a control pressure chamber defined by the movable body and the fixed body, the movable body includes a main portion and a circumferential wall, the main portion includes an insertion hole through which the drive shaft is inserted to allow the movable body to move in a direction along the rotation axis, the circumferential wall is formed integrally with the main portion and extended in the direction along the rotation axis to surround the fixed body, the actuator is configured to move the movable body with an interior pressure of the control pressure chamber, the housing includes an accommodation wall capable of accommodating the movable body, the circumferential wall and the fixed body are arranged to be spaced by a first clearance, the drive shaft and a wall defining the insertion hole are arranged to be spaced by a second clearance, the circumferential wall and the accommodation wall are arranged to be spaced by a third clearance, the drive shaft and the first radial bearing are arranged to be spaced by a fourth clearance, the drive shaft and the second radial bearing are arranged to be spaced by a fifth clearance, and the first clearance differs in size from the second clearance, while a sum of the third clearance and the smaller one of the first and second clearances is larger than the fourth clearance and the fifth clearance to limit application of a radial load to the movable body when the drive shaft is displaced in a radial direction.

2. The variable displacement swash plate compressor according to claim 1, wherein the third clearance is larger than the first clearance and the second clearance, while a difference of the third clearance and the smaller one of the first and second clearances is larger than the fourth clearance and the fifth clearance to limit contact of the circumferential wall and the accommodation wall when the drive shaft is displaced in the radial direction.

3. The variable displacement swash plate compressor according to claim 1, wherein the third clearance is smaller than the first clearance and the second clearance, a difference of the first clearance and the third clearance is larger than the fourth clearance and the fifth clearance, and a difference of the second clearance and the third clearance is larger than the fourth clearance and the fifth clearance to limit contact of the circumferential wall and the fixed body when the drive shaft is displaced in the radial direction.

4. The variable displacement swash plate compressor according to claim 1, further comprising a slide layer formed on at least one of the movable body and the fixed body to reduce slide resistance between the movable body and the fixed body.

5. The variable displacement swash plate compressor according to claim 1, further comprising a slide layer formed on at least one of the movable body and the accommodation wall to reduce slide resistance between the movable body and the accommodation wall.

* * * * *